United States Patent [19]

Esaki

[11] Patent Number: 5,000,666

[45] Date of Patent: Mar. 19, 1991

[54] CONTROL DEVICE FOR VARIABLE DISPLACEMENT TYPE COMPRESSOR

[75] Inventor: Hidenori Esaki, Saitama, Japan

[73] Assignee: Honda Giken Kogyo Kabushiki Kaisha, Tokyo, Japan

[21] Appl. No.: 439,396

[22] PCT Filed: Jan. 13, 1989

[86] PCT No.: PCT/JP89/00031

§ 371 Date: Oct. 25, 1989

§ 102(e) Date: Oct. 25, 1989

[87] PCT Pub. No.: WO89/06752

PCT Pub. Date: Jul. 27, 1989

[30] Foreign Application Priority Data

Jan. 14, 1988 [JP] Japan ..... 63-5883

[51] Int. Cl.[5] ..... F04B 1/28

[52] U.S. Cl. ..... 417/222

[58] Field of Search ..... 417/222, 222 S

[56] References Cited

U.S. PATENT DOCUMENTS

| | | | |
|---|---|---|---|
| 4,037,993 | 7/1977 | Roberts | 417/222 S |
| 4,061,443 | 12/1977 | Black et al. | 417/222 |
| 4,231,713 | 11/1980 | Widdowson et al. | 417/222 |
| 4,428,718 | 1/1984 | Skinner | 417/222 S |
| 4,688,997 | 8/1987 | Suzuki et al. | 417/222 S |
| 4,723,891 | 2/1988 | Takenaka et al. | 417/222 S |
| 4,932,843 | 6/1990 | Itoigawa et al. | 417/222 |

FOREIGN PATENT DOCUMENTS

| | | | |
|---|---|---|---|
| 220798 | 5/1987 | European Pat. Off. | 417/222 S |
| 3609058 | 10/1986 | Fed. Rep. of Germany . | |
| 1-41680 | 2/1989 | Japan . | |

*Primary Examiner*—Leonard E. Smith

*Attorney, Agent, or Firm*—Armstrong, Nikaido, Marmelstein, Kubovcik & Murray

[57] ABSTRACT

A control device for a variable displacement swashplate type compressor, said compressor comprising a control piston connected to a sleeve and moved in response to pressure of a control pressure chamber in order to adjust an operating stroke of an operating piston by varying a position of angular displacement around the axis of the support shaft of an holder and a swashplate, a control valve being interposed among an intake chamber and a discharge chamber of said compressor and said control pressure chamber in order to control the discharge capacity of the compressor in response to intake pressure, wherein the control valve comprises a first valve mechanism capable of putting the discharge chamber and the control pressure chamber into and out of communication with each other and a second valve mechanism capable of putting the control pressure chamber and the intake chamber into and out of communication with each other, said first valve mechanism being opened when the pressure of the intake chamber is less than a first set pressure and closed when said pressure is equal to or more than the first set pressure, said second valve mechanism being opened when the pressure of the intake chamber is equal to or more than a second set pressure which is smaller than the first set pressure and closed when said pressure is less than the second set pressure.

1 Claim, 2 Drawing Sheets

CONTROL DEVICE FOR VARIABLE DISPLACEMENT TYPE COMPRESSOR

TECHNICAL FIELD

The present invention relates to a control device for a variable displacement type compressor, said compressor comprising a housing having a plurality of cylinder bores arranged around a rotational driving shaft, an operating piston slidably fitted in each of said cylinder bores, a swashplate connected to said operating piston through a connecting rod, a holder supporting said swashplate, capable of being swung about an axis of a support shaft perpendicular to an axis of the rotational driving shaft and being connected to the rotational driving shaft, and a control piston connected to a sleeve and moved in response to pressure of a control pressure chamber in order to adjust an operating stroke of the operating piston by varying a position of angular displacement around the axis of the support shaft of said holder and said swashplate, a control valve being interposed among an intake chamber, a discharge chamber of said compressor and said control pressure chamber in order to control the discharge amount of the compressor in response to intake pressure.

TECHNICAL SUBJECT

In the past, such a control device as described above uses, for example, a control valve as shown in FIG. 3 to control pressure of a control pressure chamber. That is, an intake pressure Ps is introduced into an intake pressure chamber 64' around a bellows 71' into which atmospheric pressure is introduced, a push rod 59' having a base end connected to the bellows 71' is inserted into a passage hole 68' connecting a valve chamber 60' into which discharge pressure Pd is introduced and said intake pressure chamber 64' in order to drive a spherical valve body 57' encased in the valve chamber 60' to open and close between the valve chamber 60' and the passage hole 68', and a passage 53' on which control pressure Pc exerts is opened to the internal surface of an intermediate portion of the passage hole 68'.

In the above-described conventional device, when the intake pressure Ps exerting on the intake pressure chamber 64' is less than the set value, the bellows 71' expands, the valve body 57' is driven to be opened by the push rod 59' and the discharge pressure is introduced into the control pressure chamber. When the intake pressure Ps of the intake pressure chamber 64' becomes equal to or more than the set value, the bellows 71' is contracted, the valve body 57' is operated to be closed to cause the passage 53' to be communicated with the intake pressure chamber 64', and the control pressure Pc of the control pressure chamber is lowered.

However, when a section between the valve chamber 60' and the passage 53' is cut off, a section between the passage 53' and the intake pressure chamber 64 is communicated, and conversely when a section between the passage 53' and the intake pressure chamber 64' is cut off, a section between the valve chamber 60' and the passage 53' is communicated. Therefore, pressure of the control pressure chamber abruptly varies, and hunting occurs in variation in displacement of the compressor, thus deteriorating the driveability and durability.

DISCLOSURE OF THE INVENTION

The present invention has been accomplished in view of the foregoing. It is an object of the present invention to provide a control device for a variable displacement type compressor which prevents an occurrence of hunting in variation in displacement of a compressor.

According to the present invention, the control valve comprises a first valve mechanism capable of putting the discharge chamber and the control pressure chamber into and out of communication with each other and a second valve mechanism capable of putting the control pressure chamber and the intake chamber into and out of communication with each other, said first valve mechanism being opened when the pressure of the intake chamber is less than a first set pressure and closed when said pressure is equal to or more than the first set pressure, said second valve mechanism being opened when the pressure of the intake chamber is equal to or more than a second set pressure which is smaller than the first set pressure and closed when said pressure is less than the second set pressure.

According to the above-described construction, when the intake pressure is between the first and second set pressures, both the valve mechanisms are opened, and therefore the pressure of the control pressure chamber can be smoothly varied. Thus, the driveability and durability can be improved by the smooth control.

BRIEF DESCRIPTION OF THE DRAWINGS

FIGS. 1 and 2 show one embodiment of the present invention, in which FIG. 1 is a longitudinal sectional side view, FIG. 2 is a characteristic curve showing the opening and closing of a control valve.

BEST MODE FOR CARRYING OUT THE INVENTION

One embodiment of the present invention will be described with reference to the drawings.

Figure 1:
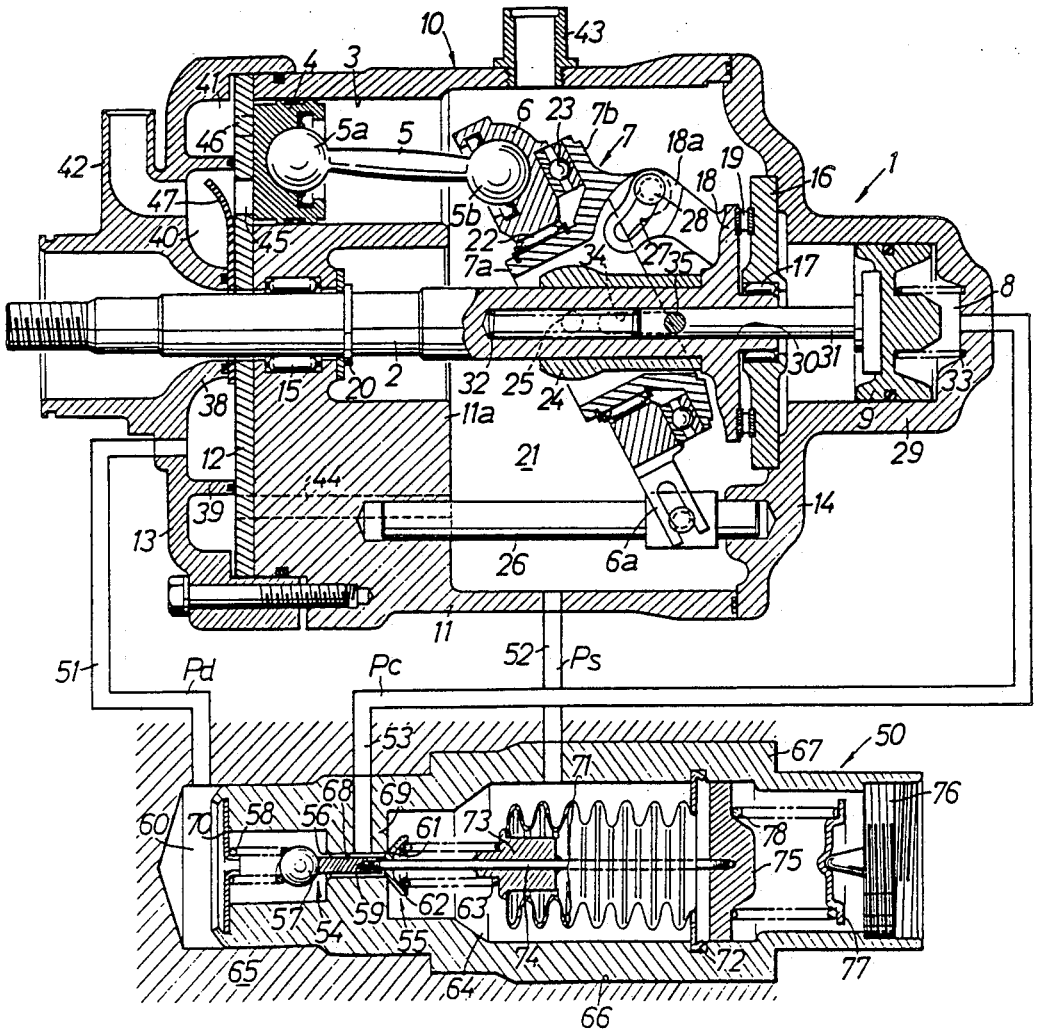

First, referring to FIG. 1, a variable displacement type compressor 1, which is applied, for example, to an air conditioner mounted on an automobile, comprises a rotational driving shaft 2, an operating piston 4 slidably fitted in each of a plurality of cylinder bores 3 arranged around the rotational driving shaft 2, a swashplate 6 connected to each of the operating pistons 4 through a connecting rod 5, a holder 7 supporting said swashplate 6 and being arranged swingably around the axis perpendicular to the axis of the rotational driving shaft 2, and a control piston 9 arranged to be moved in response to pressure of a control pressure chamber 8 and connected to said holder 7.

A housing 10 for the variable displacement type compressor 1 comprises a housing body 11 in the form of a bottomed-cylinder having a block portion 11*a* at one end thereof, a first cover 13 coupled to one end of the housing body 11 through an end place 12, and a second cover 14 coupled to the other end of the housing body 11 to close the open end thereof.

The rotational driving shaft 2 is arranged to rotatably extend through the first cover 13, the end plate 12 and the block portion 11*a*, the intermediate portion of the rotational driving shaft 2 being supported on the block portion 11*a* through a radial bearing 15, the rotational driving shaft 2 having one end protruded outwardly from the first cover 13. The other end of the rotational driving shaft 2 is supported through a radial bearing 17 on a receiving plate 16 received by the second cover 14, and a thrust bearing 19 is interposed between an integrally fixedly mounted driving plate 18 extended radially outwardly near the other end of the rotational driving shaft 2 and said receiving plate 16. A stop ring 20 received by the block portion 11*a* is fixedly mounted on the intermediate portion of the rotational driving shaft 2. Power from a crank shaft of the internal combustion engine (not shown) is transmitted to one end of the rotational driving shaft 2 to thereby rotate the rotational driving shaft 2.

In the block portion 11*a*, a plurality of cylinder bores 3 surrounding the rotational driving shaft 2 are bored parallel to the rotational driving shaft 2, and the operating pistons 4 are respectively slidably fitted into the cylinder bores 3. One end of each of the cylinder bores 3 is closed by the end plate 12.

The holder 7 and the swashplate 6 supported by the holder 7 are arranged within an operating chamber 21 formed within the housing 10 between the second cover 14 and the block portion 11*a*. The holder 7 comprises a tubular portion 7*a* encircling the rotational driving shaft 2 and a flange 7*b* disposed on the end of the tubular portion 7*a*. A radial bearing 22 is disposed between the tubular portion 7*a* and the swashplate 6, and a thrust bearing 23 is disposed between the flange 7*b* and the swashplate 6 so as to support the swashplate 6 on the holder 7. Within the operating chamber 21, a cylindrical sleeve 24 is axially movably fitted over the rotational driving shaft 2, and the holder 7 is swingably supported by a pair of support shafts 25 protruded outwardly along one diametral line from the outer surface of the sleeve 24, that is, perpendicular to the axis of the rotational driving shaft 2.

A guide shaft 26 parallel to the rotational driving shaft 2 is mounted over and between the block portion 11*a* and the second cover 14, and a slidable guide arm 6*a* in engagement with the guide shaft 26 is provided on the swashplate 6. A connecting arm 18*a* extending toward the holder 7 is provided on a driving plate 18 fixedly mounted on the rotational driving shaft 2, and an engaging pin 28 projected from the holder 7 is engaged with an engaging hole 27 formed in the fore end of the connecting arm 18*a*. The engaging hole 27 is made in the form of an arc to maintain the engaging state with the engaging pin 28 despite the rotation of the holder 7 about the axis of the support shaft 25. Accordingly, the holder 7 and the swashplate 6 are rotated in response to the rotation of the rotational driving shaft 2.

At one end of each of the connecting rods 5 is provided a spherical head 5*a*, which is engaged with each operating piston 4. At the other end of each connecting rod 5 is also provided a spherical head 5*b*, which is engaged with the swashplate 6. Accordingly, the operating stroke of the operating piston 4, that is, the discharge amount is determined according to the position of angular displacement of the swashplate 6 around the axis of the support shaft 25.

An outwardly protruded bottomed-cylindrical cylinder tube portion 29 is projected coaxial with the rotational driving shaft 2 in the central portion of the second cover 14. The control piston 9 is slidably fitted into the cylinder tube portion 29, and the control pressure chamber 8 is defined between the control piston 9 and the outer closed end of the cylinder tube portion 29. A bottomed sliding hole 30 which is opened to the other end surface of the rotational driving shaft 2 and faces to the cylinder tube portion 29 is coaxially bored in a portion close to the other end of the rotational driving shaft 2, and a rod 31 is slidably fitted into the sliding hole 30. A return spring 32 is retained in compression between the closed end of the sliding hole 30 and one end of the rod 31, the rod 31 being urged in a direction of being projected from the other end of the rotational driving shaft 2. The other end of the rod 31 is coaxially connected to the control piston 7 so that the rotation of the rod 31 is not transmitted, and a balance spring 33 having a force against the spring 32 to stabilize the movement of the control piston 9 is encased in the control pressure chamber 8.

A guide hole 34 opened to the inner surface of the sliding hole 30 is bored in a diametral linear fashion in a portion close to the other end of the rotational driving shaft 2, and a connecting pin 35 extending through the guide hole 34 and connected to the sleeve 24 is secured to the rod 31. The guide hole 34 extends lengthwise in an axial direction of the rotational driving shaft 2, and the sleeve 24 is axially moved according to the sliding movement of the control piston 9 within the sliding hole 30 of the rod 31 according to the sliding operation of the control piston 9 to vary the position of angular displacement around the axis of the support shaft 25 of the holder 7 and the swashplate 6 accordingly. That is, when the control piston 9 is moved leftwards in FIG. 1, the sleeve 24 is also moved leftwards, and the holder 7 and the swashplate 6 are turned clockwise in FIG. 1 accordingly, whereby the operating stroke of the operating piston 4 becomes small. When the control piston 9 is moved rightwards in FIG. 1, the sleeve 24 is also moved rightwards, and the holder 7 and the swashplate 6 are turned counterclockwise in FIG. 1 accordingly, whereby the operating stroke of the operating piston 4 becomes large.

The first cover 13 is basically in the form of a dish or a plate so that the outer peripheral edge thereof is fitted into one end of the housing body 11. The first cover 13 is provided with a small diameter tubular portion 38 encircling the rotational driving shaft 2 and a large diameter tubular portion 39 coaxially encircling the small diameter tubular portion 38, both the tubular portions 38 and 39 being brought into contact with the end plate 12. Thereby, between the housing body 11 and the first cover 13 are defined a discharge chamber 40 on the inward side and an intake chamber 41 on the outward side, the first cover 13 being integrally provided with a discharge pipe portion 42 leading to the discharge chamber 40. An intake pipe portion 43 leading to the operating chamber 21 is provided on the side wall of the housing body 11, and a passage 44 to provide a communication between the operating chamber 21 and the intake chamber 41 is bored in the block portion 11*a*.

The end plate 12 has a discharge hole 45 leading into the cylinder bore 3, the discharge hole 45 corresponding to the discharge chamber 40, and an intake hole 46 leading into the cylinder bore 3 is bored corresponding to the intake chamber 41. A discharge valve 47 for opening the discharge hole 45 when the operating piston 4 is compressed and an intake valve (not shown) for opening the intake hole 46 when the operating piston 4 is operated for intaking are disposed on the end plate 12.

A control valve 50 for carrying out a displacement control of the compressor 1 according to the intake pressure Ps is interposed among a passage 51 in communication with the discharge chamber 40, a passage 52 in communication with the intake chamber 41 through the passage 44 and the operating chamber 21, and a passage 53 in communication with the control pressure chamber 8, and comprises a first valve mechanism 54 capable of putting the passage 51 and the passage 53 into and out of communication with each other, and a second valve mechanism 55 capable of putting the passage 52 and the passage 53 into communication with each other.

The first valve mechanism 54 comprises a spherical valve body 57 seatable on a valve seat 56, a valve spring 58 for urging the valve body 57 in a direction of opening the valve, and a push rod 59 for driving the valve body 57 in a direction of opening the valve, the valve body 57 and the valve spring 58 being encased in a valve chamber 60. The second valve mechanism 55 comprises a frusto-conical valve body 62 seatable on a valve seat 61, a valve spring 63 for urging the valve body 62 in a direction of closing the valve, the valve body 62 and the valve spring 63 being encased in an intake pressure chamber 64.

The valve chamber 60 is defined between a closed end of a bottomed hole 66 provided on a fixed support body 65 and the fore end of a valve tube 67 which is basically cylindrical and fitted and secured to the bottomed hole 66, the passage 51 being communicated with the valve chamber 60. In the inner surface of the intermediate portion of the valve tube 67 is radially inwardly extended a partition wall portion 69 which defines the valve chamber 60 from an intake pressure chamber 64 in communication with the passage 52, and in the center of the partition wall portion 69 is provided a passage hole 68 connecting between the valve chamber 60 and the intake pressure chamber 64, the passage hole 68 being coaxial with the valve tube 67. The valve seat 56 is formed in the open end edge on the side of the valve chamber 60 of the passage hole 68, and valve seat 61 is formed in the open end edge on the side of the intake pressure chamber 64 of the passage hole 68. The passage 53 is opened into the inner surface of the intermediate portion of the passage hole 68.

Within the valve chamber 60, valve spring 58 has one end which is supported on a spring receiving plate 70 caulked to the fore end of the valve tube 67, and the other and which is brought into contact with the valve body 57 seatable on the valve seat 56. Thereby, the valve body 57 is urged in a seating direction on the valve seat 56. The push rod 59 is inserted into a passage hole 68, and when the push rod 59 is moved toward the valve chamber 60 within the passage hole 68, the valve body 57 is pressed by the push rod 59 to move away from the valve seat 56 against the force of the valve spring 58 to open the first valve mechanism 54.

Within the valve tube 67 opposite to the valve chamber 60 with respect to the partition wall portion 69, a bellows 71 cylindrically formed coaxial with the valve tube 67 is arranged expansively in an axial direction thereof, and a ring-like support plate 72 secured to the base end of the bellows 71 is secured to the inner surface of the valve tube 67 with the fore end of the bellows 71 directed towards the partition wall portion 69 thereby forming the intake pressure chamber 64 surrounding the bellows 71 within the valve tube 67. One end of a bar-like connecting member 74 with an intermediate portion thereof secured to a support member 73 secured to the central portion at the fore end of the bellows 71 movably extends through the valve body 62 of the second valve mechanism 55 and is coaxially secured to the push rod 59. The other end of the connecting member 74 is secured to a sliding plate 75 slidably fitted into the valve tube 67, and a spring 78 is retained in compression between the sliding plate 75 and a spring member 77 received by an adjusting screw 76 threadedly engaged with the rear end of the valve tube 67 so that the screw 76 may be moved forward and backward. Accordingly, by the adjustment of the forward or backward position of the adjusting screw 76, a reference position of the fore end of the bellows 71 can be adjusted. The valve spring 63 of the second valve mechanism 55 is interposed between the support member 73 and the valve body 62.

In such a control valve 50, when the intake pressure Ps within the intake pressure chamber 64 lowers, the bellows 71 expands, and the first valve mechanism 54 is opened to communicate between the passages 51 and 53, at which time the second valve mechanism 55 is closed. When the intake pressure Ps within the intake pressure chamber 64 increases, the bellows 71 is contracted, and the first valve mechanism 54 is closed whereas the second valve mechanism 55 is opened. The first valve mechanism 54 is set so that it is opened when the intake pressure Ps is less than the first set pressure $P_1$ and closed when equal to or more than the first set pressure $P_1$. The second valve mechanism 55 is set so that it is opened when the intake pressure Ps is equal to or more than the second set pressure $P_2$ which is smaller than the first set pressure $P_1$ and closed when less than the second set pressure $P_2$.

Next, the operation of this embodiment will be described. When the load of the air conditioner decreases to lower the intake pressure Ps, the first valve mechanism 54 opens as the intake pressure Ps becomes less than the first set pressure $P_1$ to communicate between the passages 51 and 53, whereby the pressure of the control pressure chamber 8 increases and the control piston 9 is moved leftward in FIG. 1 accordingly and the holder 7 is turned clockwise. Thus, the operating stroke of the operating piston 4 becomes small and the discharge amount is reduced.

When the load of the air conditioner increases and the intake pressure Ps increases, the second valve mechanism 55 is opened as the intake pressure Ps becomes equal or greater than the second set pressure $P_2$ to communicate between the passages 52 and 53. Therefore, the pressure of the control pressure chamber 8 is reduced, and the control piston 9 is moved rightwards in FIG. 1 and the holder 7 is turned counter-clockwise accordingly. Thus, the operating stroke of the operating piston 4 becomes large and the discharge amount increases.

Figure 2:
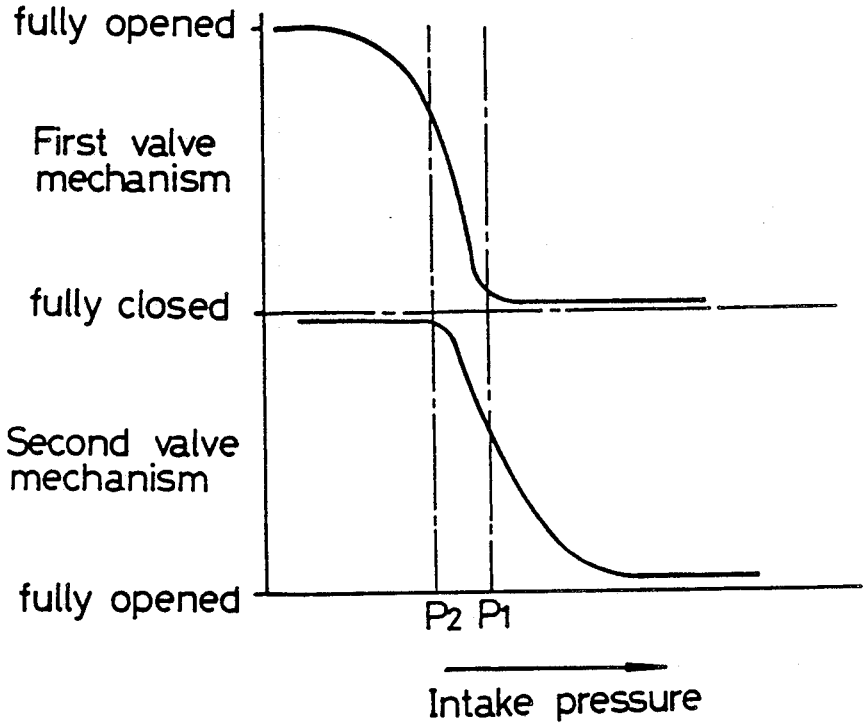
Figure 3:
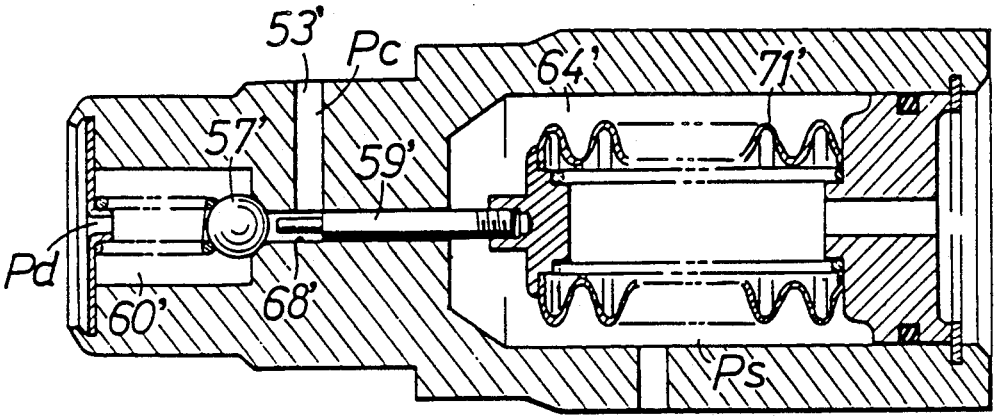
FIG. 3 is a longitudinal sectional view showing the construction of a conventional control valve.

The discharge amount of the variable displacement type compressor 1 is controlled in a manner as described above. However, in the control valve 50, both the first and second valve mechanisms 54 and 55 are opened when the intake pressure Ps is less than the first set pressure $P_1$ and equal to or more than the second set pressure $P_2$, as shown in FIG. 2, and during which section, the pressure of the control pressure chamber 8 smoothly varies from the discharge pressure Pd to the intake pressure Ps. Accordingly, the pressure of the control pressure chamber 8 is not abruptly varied as in the conventional prior art but the movement of the control piston 9 can be made smooth to distribute to the improvement in driveability and durability.

What is claimed is:

1. A control device for a variable displacement type compressor, said compressor comprising a housing having a plurality of cylinder bores arranged around a rotational driving shaft, an operating piston slidably fitted in each of said cylinder bores, a swashplate connected to said operating piston through a connecting rod, a holder supporting said swashplate, capable of being swung about an axis of a support shaft perpendicular to an axis of the rotational driving shaft and being connected to the rotational driving shaft, and a control piston connected to a sleeve and moved in response to pressure of a control pressure chamber in order to adjust an operating stoke of the operating piston by varying a position of angular displacement around the axis of the support shaft of said holder and said swashplate, a control valve being interposed among an intake chamber and a discharge chamber of said compressor and said control pressure chamber in order to control the discharge capacity of the compressor in response to intake pressure, wherein the control valve comprises a first valve mechanism capable of putting the discharge chamber and the control pressure chamber into and out of communication with each other and a second valve mechanism capable of putting the control pressure chamber and the intake chamber into and out of communication with each other, said first valve mechanism being opened when the pressure of the intake chamber is less than a first set pressure and closed when said pressure is equal to or more than the first set pressure, said second valve mechanism being opened when the pressure of the intake chamber is equal to or more than a second set pressure which is smaller than the first set pressure and closed when said pressure is less than the second set pressure.

* * * * *